US010934810B2

(12) United States Patent
Dancer

(10) Patent No.: US 10,934,810 B2
(45) Date of Patent: Mar. 2, 2021

(54) ONE-TRIP MULTILATERAL TOOL

(71) Applicant: Halliburton Energy Services, Inc., Houston, TX (US)

(72) Inventor: William Wallace Dancer, Little Elm, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 237 days.

(21) Appl. No.: 15/760,601

(22) PCT Filed: Nov. 17, 2015

(86) PCT No.: PCT/US2015/061102

§ 371 (c)(1),
(2) Date: Mar. 15, 2018

(87) PCT Pub. No.: WO2017/086936

PCT Pub. Date: May 26, 2017

(65) Prior Publication Data

US 2019/0085661 A1 Mar. 21, 2019

(51) Int. Cl.
*E21B 41/00* (2006.01)
*E21B 7/06* (2006.01)
(Continued)

(52) U.S. Cl.
CPC ..... *E21B 41/0035* (2013.01); *E21B 7/061* (2013.01); *E21B 23/01* (2013.01);
(Continued)

(58) Field of Classification Search
CPC ..... E21B 7/061; E21B 29/06; E21B 41/0035
See application file for complete search history.

(56) References Cited

U.S. PATENT DOCUMENTS 5,335,737 A * 8/1994 Baugh ..... E21B 7/061 175/61
5,427,177 A * 6/1995 Jordan, Jr. ..... E21B 7/061 166/117.5

(Continued)

FOREIGN PATENT DOCUMENTS

WO WO-2005/019597 A1 3/2005
WO 2014058412 4/2014

(Continued)

OTHER PUBLICATIONS

Russian Office Action for Application No. 2018113752, dated May 21, 2019.

(Continued)

*Primary Examiner* — Steven A Macdonald
(74) *Attorney, Agent, or Firm* — Scott Richardson; C. Tumey Law Group PLLC

(57) ABSTRACT

A multilateral tool and methods and systems related thereto, the multilateral tool conveyable into a parent wellbore and a lateral wellbore and having a plurality of components operatively coupled together such that movement of a component correspondingly moves the adjacent component. The plurality of components comprise a whipstock having a latch anchor, a drill bit, a measurement while drilling (MWD) tool, a motor, at least one well screen, and a multilateral junction having a primary leg and a lateral leg.

20 Claims, 5 Drawing Sheets

(51) Int. Cl.

| | |
|---|---|
| ***E21B 23/01*** | (2006.01) |
| ***E21B 29/06*** | (2006.01) |
| ***E21B 43/08*** | (2006.01) |
| ***E21B 47/00*** | (2012.01) |

(52) U.S. Cl.
CPC ..... *E21B 29/06* (2013.01); *E21B 43/08* (2013.01); *E21B 47/00* (2013.01)

(56) References Cited

U.S. PATENT DOCUMENTS

| | | | | |
|---|---|---|---|---|
| 5,579,829 | A * | 12/1996 | Comeau | E21B 23/02 166/117.6 |
| 5,826,651 | A * | 10/1998 | Lee | E21B 7/061 166/117.6 |
| 6,050,334 | A | 4/2000 | McGarian et al. | |
| 6,209,644 | B1 | 4/2001 | Brunet | |
| 6,241,021 | B1 | 6/2001 | Bowling | |
| 6,454,007 | B1 * | 9/2002 | Bailey | E21B 4/02 166/298 |
| 6,752,211 | B2 | 6/2004 | Dewey et al. | |
| 7,095,279 | B2 | 8/2006 | Bollati | |
| 8,347,968 | B2 | 1/2013 | Debard et al. | |
| 8,376,066 | B2 | 2/2013 | Steele et al. | |
| 8,789,590 | B2 | 7/2014 | Donovan | |
| 2001/0041963 | A1 * | 11/2001 | Estes | G01C 19/38 702/6 |
| 2003/0213599 | A1 * | 11/2003 | Tinker | E21B 7/061 166/380 |
| 2004/0003925 | A1 | 1/2004 | Desai | |
| 2004/0149444 | A1 * | 8/2004 | Cavender | E21B 41/0042 166/313 |
| 2004/0159435 | A1 * | 8/2004 | Plucheck | E21B 41/0042 166/313 |
| 2005/0241830 | A1 * | 11/2005 | Steele | E21B 43/103 166/313 |
| 2012/0090687 | A1 * | 4/2012 | Grigsby | E21B 43/045 137/1 |
| 2012/0111636 | A1 * | 5/2012 | Steele | E21B 7/061 175/61 |
| 2013/0319653 | A1 * | 12/2013 | Ibragimov | E21B 7/061 166/117.6 |
| 2013/0319666 | A1 | 12/2013 | Nygardsvoll et al. | |
| 2013/0327572 | A1 * | 12/2013 | Sponchia | E21B 41/0035 175/61 |
| 2014/0124198 | A1 * | 5/2014 | Donovan | E21B 41/0035 166/255.1 |
| 2014/0246241 | A1 | 9/2014 | Phillips | |
| 2015/0068756 | A1 * | 3/2015 | Pendleton | E21B 41/0035 166/313 |
| 2015/0184460 | A1 | 7/2015 | Alsup et al. | |

FOREIGN PATENT DOCUMENTS

| | | | |
|---|---|---|---|
| WO | WO-2015/034608 | A1 | 3/2015 |
| WO | WO-2015/187297 | A1 | 12/2015 |

OTHER PUBLICATIONS

Balstad et al., "New Single-Trip, TAML Level 4, Multilateral Junction Technology Reduces Well Costs in Norwegian Sea Subsea Well—A Case History," SPE 123935, 2009, 11 pages.

International Search Report and Written Opinion from PCT/US2015/061102, dated Aug. 17, 2016, 12 pages.

* cited by examiner

ONE-TRIP MULTILATERAL TOOL

BACKGROUND

The present disclosure relates generally to completing wellbores in the oil and gas industry and, more particularly, to a one-trip multilateral tool used to complete one or more legs of a multilateral well.

Wellbores are typically drilled using a drill string with a drill bit secured to its lower free end and then completed by positioning a casing string within the wellbore and cementing the casing string in position. In recent years, technology has been developed which allows an operator to drill what may be alternately referred to as either a primary or parent wellbore, and subsequently drill what may be alternately referred to as either a secondary or lateral wellbore that extends from the parent wellbore at a desired orientation and to a chosen depth. The parent wellbore is first drilled and then may be at least partially lined with a string of casing. The casing is subsequently cemented into the wellbore by circulating a cement slurry into the annular regions between the casing and the surrounding formation wall. The combination of cement and casing strengthens the parent wellbore and facilitates the isolation of certain areas of the formation behind the casing for the production of hydrocarbons to an above ground location at the earth's surface where hydrocarbon production equipment is located. In many instances, the parent wellbore is completed at a first depth, and is produced for a given period. Production may be obtained from various zones by perforating the casing string.

At a later time, or while the parent wellbore is being drilled and completed, it is often desirable to drill a lateral wellbore from the parent wellbore. To accomplish this, a casing exit or "window" must be created in the casing of the parent wellbore. The window can be formed by positioning a whipstock in the casing string at a desired location in the parent wellbore. The whipstock is used to deflect one or more mills laterally (or in an alternative orientation) relative to the casing string and thereby penetrate part of the casing to form the window. A drill bit can be subsequently inserted through the window in order to drill the lateral wellbore to the desired length, and the lateral wellbore can then be completed as desired.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

Figure 1:
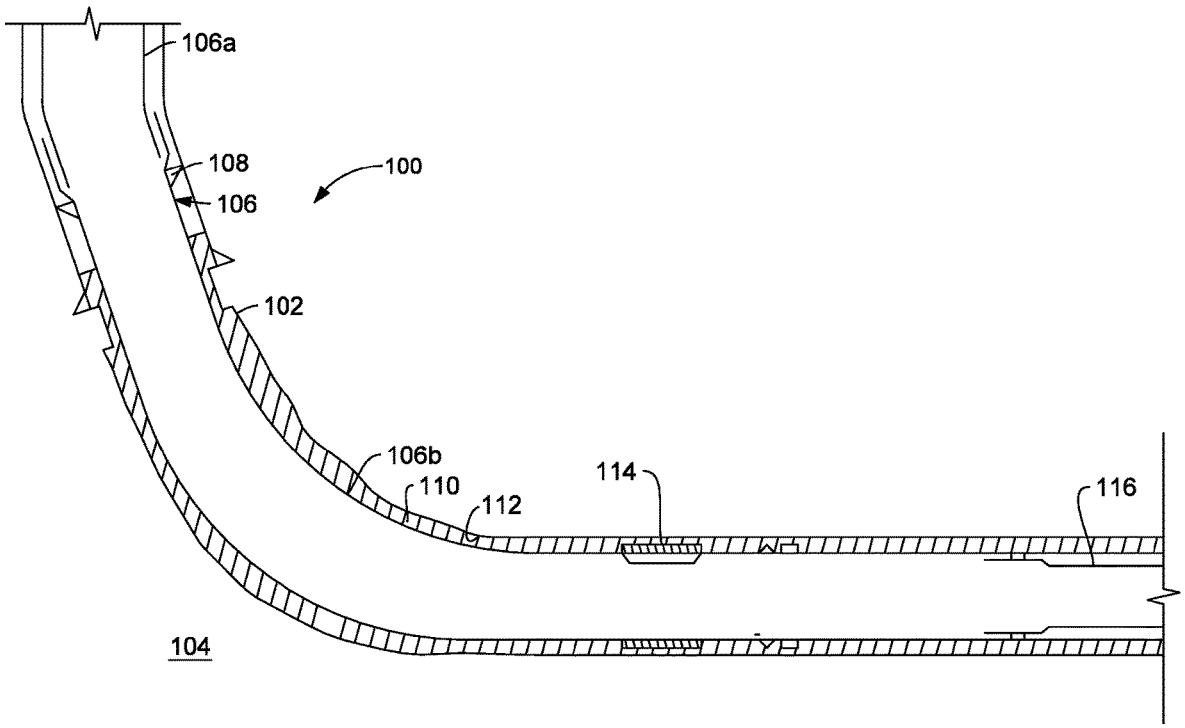
FIG. 1, illustrated is a cross-sectional side view of a well system that may employ from the principles of the present disclosure.

The present disclosure relates generally to completing wellbores in the oil and gas industry and, more particularly, to a one-trip multilateral tool used to complete one or more legs of a multilateral well.

The embodiments described herein improve the efficiency of drilling and completing multilateral wellbores, and thereby improve or maximize production of each lateral wellbore extending from a parent wellbore. Additionally, the embodiments described herein improve the costs associated with traditional drilling and completion of multilateral wellbores. More specifically, the one-trip multilateral tool described herein employs a single tool that enters a parent wellbore only once to achieve drilling and completion of a lateral wellbore.

The efficiency of the one-trip multilateral tool and associated systems and methods described herein is characterized by reducing the downhole trip requirements for installing and using the tool to drill and complete a lateral wellbore. Such trip savings translate into eliminating one to four, or even more, trips downhole to perform the same operation at significant cost savings. Indeed, it is estimated that each trip downhole costs approximately $500,000 USD. Thus, the one-trip multilateral tool of the present disclosure results in significant financial benefits, as well as increased efficiencies related to shorter installation time, reduced rig time, safety advantages, and the like.

According to the embodiments described herein, a one-trip multilateral tool can be conveyed into a parent wellbore lined at least partially with casing and used to drill and complete a lateral wellbore in a single trip downhole. The one-trip multilateral tool comprises a plural of components operatively coupled together. As used herein, the term "operatively coupled" refers to a direct or indirect coupling engagement between at least two components such that movement of a first component correspondingly moves the second component. Accordingly, a plurality of components may be operatively coupled such that movement of any one component correspondingly moves the plurality of components. The plurality of components operatively coupled together to form the one-trip multilateral tool of the present disclosure includes a whipstock having a latch anchor, a drill bit, a measurement while drilling (MWD) tool, a motor, at least one well screen, and a multilateral junction having a primary leg and a lateral leg.

When running the one-trip multilateral tool into a parent wellbore, the latch anchor is operatively coupled to the whipstock at a releasable connection and secured within the parent wellbore by mating a latch profile of the latch anchor with a latch coupling included in the casing in the parent wellbore. After milling a window and drilling a lateral wellbore using the one-trip multilateral tool, the at least one screen may be actuated to facilitate production from the lateral wellbore. In some embodiments, the plurality of components of the one-trip multilateral tool remain in the parent and lateral wellbore during production and are never retrieved. In other embodiments, it may be desirable to retrieve the one-trip multilateral tool, such as for use in a subsequent operation requiring drilling and completion of a lateral wellbore. In such embodiments, the one-trip multilateral tool may be separated from the latch anchor or the latch anchor may be separated from the latch coupling and the one-trip multilateral tool retrieved (e.g., using a retrieving tool), without departing from the scope of the present disclosure.

Referring first to FIG. 1, illustrated is a cross-sectional side view of the well system 100 that may employ the principles of the present disclosure. As illustrated, the well system 100 may include a parent wellbore 102 that is drilled through various subterranean formations, including formation 104, which may comprise a hydrocarbon-bearing formation. Following drilling operations, the parent wellbore 102 may be completed by lining all or a portion of the parent wellbore 102 with liner or casing 106, shown as a first string of casing 106*a* and a second string of casing 106*b* that extends from the first string of casing 106*a*. The first string of casing 106*a* may extend from a surface location (i.e., where a drilling rig and related drilling equipment is located) or from an intermediate point between the surface location and the formation 104, and the second string of casing 106*b* may extend from or is otherwise hung off the first string of casing 106*a* at a liner hanger 108. For purposes of the present disclosure, the first and second strings of casing 106*a,b* will be jointly referred to herein as the casing 106. All or a portion of the casing 106 may be secured within the parent wellbore 102 by depositing cement 110 within the annulus 112 defined between the casing 106 and the wall of the parent wellbore 102.

In some embodiments, the casing 106 may have a pre-milled window 114 defined therein. The pre-milled window 114 may be covered with a millable or soft material that may be milled out or otherwise penetrated one-trip multilateral tool described herein to provide a casing exit used to form a lateral wellbore extending from the parent wellbore 102. In other embodiments, however, the pre-milled window 114 may be omitted from the well system 100 and the wall of the casing 106 at the location of the pre-milled window 114 may instead be milled through to create the desired casing exit using the one-trip multilateral tool described herein.

After the casing 106 has been cemented, a lower liner 116 may be extended into the parent wellbore 102 and secured to the inner wall of the casing 106 at a predetermined location downhole from the window 114, which may be pre-milled or otherwise where the casing exit is to be formed. While not shown, the lower liner 116 may include at its distal end various downhole tools and devices used to extract hydrocarbons from the formation 104, such as well screens, inflow control devices, sliding sleeves, valves, etc. Moreover, in some embodiments, the lower liner 116 may be coupled to one or more lateral wellbores (not shown) constructed downhole from the window 114 and extending from the parent wellbore 102 at a variety of angular orientations.

Figure 2:
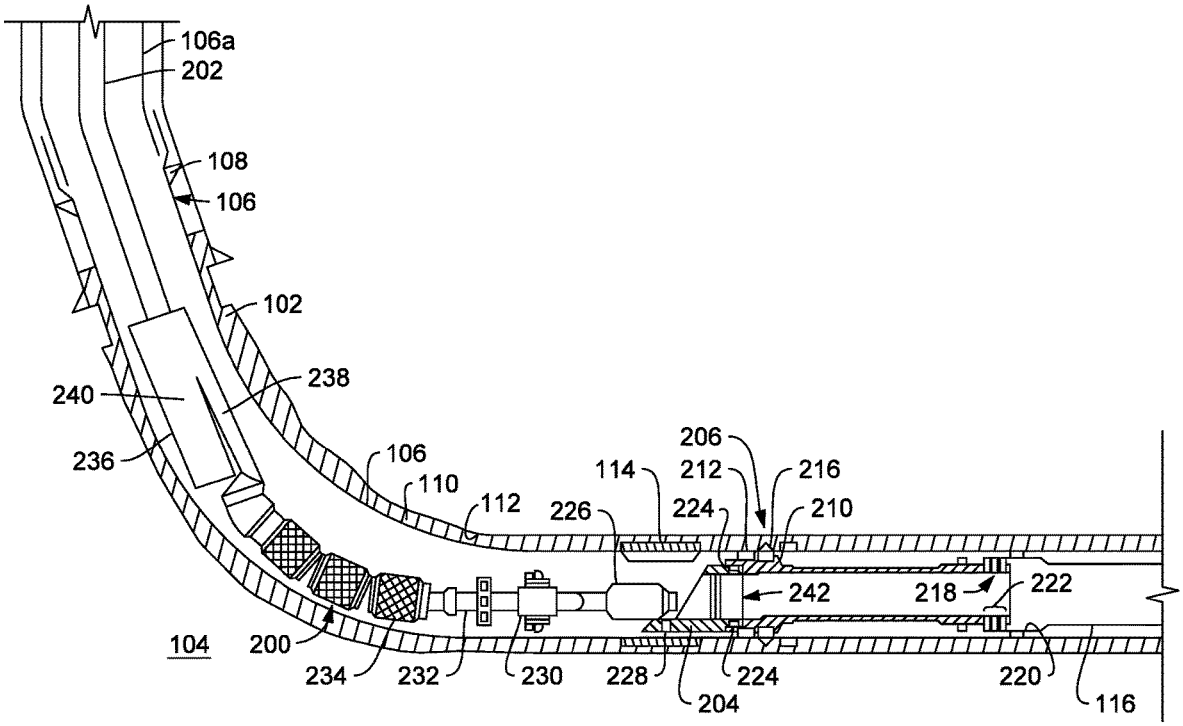
FIG. 2 depicts a cross-sectional side view of an exemplary one-trip multilateral tool before a lateral wellbore has been drilled, according to one or more embodiments of the present disclosure.

Referring to FIG. 2, once the parent wellbore 102 is completed, a one-trip multilateral tool 200 is conveyed into the parent wellbore 102 on a drill string 202, which may comprise a plurality of drilling tubulars coupled together end-to-end. As illustrated, the one-trip multilateral tool 200 (hereafter "the tool 200") comprises a whipstock 204. The whipstock 204 has a latch anchor 206. The latch anchor 206 may include a latch housing 210, a seal 212, and a latch profile 214 configured to mate with a latch coupling 216 installed in the casing 106 at a predetermined location. As the tool 200 is lowered into the parent wellbore 102, the latch profile 214 locates in the latch coupling 216 and thereby secures the tool 200 in place within the parent wellbore 102. The latch anchor 206 is used to orient the tool 200 at a predetermined orientation relative to the window 114. The seal 212 may be engaged and otherwise activated to prevent fluid migration across the latch anchor 206 at the interface between the latch housing 210 and the inner wall of the casing 106.

As shown, the whipstock 204 may further include a lower stinger assembly 218 that extends from the latch anchor 206 and is configured to be received within a seal bore 220 of the lower liner 116. As illustrated, the lower stinger assembly 218 may include one or more seals 222 configured to sealingly engage the inner wall of the seal bore 220, and thereby provide fluid and/or hydraulic isolation with the lower liner 116.

The whipstock 204 may be operatively coupled to the latch anchor 206 via a releasable connection 224 that allows the tool 200 to be subsequently separated from the latch anchor 206 and retrieved to the surface. The releasable connection 224 may comprise any connection mechanism or device that can be repeatedly locked and released as desired, including remotely, but also maintains both depth and orientation datums relative to the latch coupling 216 when initially installed. In some embodiments, the releasable connection 224 may comprise a collet or collet device. In other embodiments, however, the releasable connection 224 may comprise a latching profile, such as a lug-style receiving head with scoop guide. In yet other embodiments, the releasable connection 224 may comprise a threaded engagement and the tool 200 may be detached from the latch anchor 206 by rotating the drill string 202 and the whipstock 204 in a specific rotational direction to unthread the coupled engagement.

The whipstock 204 may further comprise one or more seals 242 that receive the multilateral junction 236, discussed below, prior to producing hydrocarbons from the subterranean formation 104 (FIG. 2). In other embodiments, as discussed below, the multilateral junction 236 and the whipstock 204 may form a fluid seal where the multilateral junction 236 is secured to the parent wellbore 102 or casing string therein.

Each of the plurality of components of the tool 200 has a first end a second end. When looking at a cross-sectional, longitudinal view of the tool 200, the second end of each component is the left end, or the end that is closer to the surface within a wellbore in terms of distance downhole (whether horizontal, vertical, or deviated distance); and the first end of each component is the right end, or the end that is farthest from the surface within a wellbore in terms of distance downhole (whether horizontal, vertical, or deviated distance).

Accordingly, the whipstock 204 has a first end and a second end. The first end of the whipstock 204 is operatively coupled to a drill bit 226, the drill bit 226 also having a first end and a second end. The drill bit 226 comprises one or more cutting elements and may be in the form of a fixed cutter bit (e.g., a polycrystalline diamond compact, natural diamond, or grit hot-pressed insert bit), a roller cone drill bit, a rotary drill bit, a tricone drill bit, a vertical drill bit, and the like. The drill bit 226 is operatively coupled to the whipstock 204 by a shear bolt 228. The shear bolt 228 is shearable to divert the drill bit 226 up the ramped surface of the whipstock 204 to mill through window 114 and drill a lateral wellbore (see FIG. 4). The shear bolt 208 may threadably engage the whipstock 204 or be otherwise bolted thereto. The shear bolt 228 is additionally releasably coupled to the drill bit 226 and when the shear bolt 208 encounters a predetermined amount of shear force parallel to the longitudinal axis of the tool 100, the shear bolt 208 breaks or otherwise fails and allows separation of the drill bit 226 from the whipstock 204. The shearable connection between the whipstock 204 and the drill bit 226 may be any releasable connection suitable in a subterranean formation, such as a torque bolt, a shear or wear bolt, and the like, without departing from the scope of the present disclosure.

With continued reference to FIG. 2, a MWD tool 230 is included in the tool 200 and has a first end and a second end. The second end of the MWD tool 230 is operatively coupled to the first end of the drill bit. The MWD tool 230 accordingly follows the drill bit 226 through the window and into the lateral wellbore (see FIG. 4) upon shearing of the shear bolt 228. Prior to shearing the shear bolt 228, the MWD tool 230 may be used to orient the tool 200 within the parent wellbore 102 and help locate the latch coupling 216. The MWD tool 230 may include one or more sensors that help confirm the angular orientation (i.e., a type of wellbore condition) of the tool 200, and thereby help ensure that the whipstock 204 and the drill bit 226 are properly oriented relative to the window 114 to form the casing exit. Upon shearing the shear bolt 228, the MWD tool 230 may be used to orient the drill bit 226 as it drills through the window 114 and a lateral wellbore (see FIG. 4). The MWD tool 230 may further include at least one sensor for detecting other wellbore conditions. Wellbore conditions include, but are not limited to, angular orientation of the tool 200 (or components thereof), drilling fluid volume, rotational speed of the motor 232, vibration of the tool 200, vibration of the downhole environment, downhole temperature, torque and weight on the drill bit, and the like, and any combination thereof. The MWD tool 230 may further comprise an electrical transmission assembly for transmitting the data regarding the wellbore condition, which may be received at a surface location.

A motor 232 is included in the tool 200 according to the embodiments of the present disclosure. The motor 232 has a first end and a second end, where the second end of the motor is operatively coupled to the first end of the MWD tool 230. The motor 232 drives the drill bit 226 to mill the window 114 and drill the lateral wellbore (see FIG. 4). The motor 230 may be electrically operated, driven by fluid pressure from the earth's surface (e.g., water, brine, diesel fluid, nitrogen, air, other treatment fluids, and the like), or otherwise operable to drive the drill bit 226, without departing from the scope of the present disclosure.

One or more screens 234 are included as part of the tool 200, the screen 234 has a first end and a second end. The second end of the screen(s) 234 is operatively coupled to the first end of the MWD tool 230. The screen(s) 234 accordingly follows the drill bit 226 and MWD tool 232 through the window and into the lateral wellbore (see FIG. 4) upon shearing of the shear bolt 228. The screen(s) 234 have a de-actuated configuration in which fluid flow is prevented from entering into the interior of the screen(s) 234, and an actuated configuration in which fluid flow is allowed to enter into the interior of the screen(s) 234 (i.e., during production of the lateral wellbore). In some embodiments, the screen(s) 234 is a sliding sleeve screen, where the screen(s) 234 is in its de-actuated configuration having a shiftable sleeve blocking fluid flow (e.g., an inner sleeve). A shear pin (not shown) may be used to hold the shiftable sleeve in place and maintain the de-actuated configuration of the screen(s) 234. At a desired time and location, a ball is dropped from the surface and through drill string 202 and multilateral junction 236 (discussed below) where it lands on a ball seat in the screen(s) 234 and applies a pressure that shears the shear pins of the screen(s) 234, thus shifting the sleeve to expose and actuate the screen(s) 234 to fluid flow. The ball is accordingly sized and weighted to apply the necessary pressure to actuate the sleeve(s) 234. In some embodiments, a plurality of screens 234 are included in the tool 200 for placement into the lateral wellbore (see FIG. 4). When so included, each screen 234 is designed to be actuated by different sized balls, the smallest ball actuating the screen 234 within the wellbore farthest in terms of distance downhole and each ball progressively larger in design to actuate one or more additional screens 234 closer toward the surface. The balls may be later circulated out of hole or drilled out with an inner string.

Although the shiftable sleeve of FIG. 2 is described as mechanically actuable (i.e., with a ball and shear pins), it is to be understood that other means of actuating the shiftable sleeve of screen(s) 234, without departing from the scope of the present disclosure. For example, in some embodiments, the screen(s) 234 are actuable by shifting the sleeve using a radio frequency identity tag (RFID), an electric control line, by hydraulic activation, or by other means of shifting the shiftable sleeve to actuate the screen(s) 234, without departing from the scope of the present disclosure.

During the milling and drilling process of the window 114 and the lateral wellbore (see FIG. 4), the screen(s) 234 is in the de-actuated configuration. Not until the multilateral junction 236 is landed are the screen(s) 234 actuated. Accordingly, pressure is maintained during the conveyance of the tool 200 and proper hydrocarbon flow is achieved in later production operations.

The multilateral junction 236 comprises a first end and a second end, where the multilateral junction 236 comprises a primary leg 240 and a lateral leg 238. The lateral leg is operatively coupled to the first end of the screen(s) 234 and the primary leg is operatively coupled to the drill string 202. The multilateral junction 236 is used to bridge the intersection between the parent wellbore 102 and the lateral wellbore (see FIG. 4). The multilateral junction 236 is a y-block junction comprising a borehole through both the primary leg 240 and the lateral leg 238 through which fluids may flow based on an internal deflector for dictating the flow of fluids through the multilateral junction 236. The deflector is capable of being remotely activated to be positioned in a neutral position, a lateral leg 238 position, or a primary leg 240 position, where depending on the position, fluid flow is allowed through both the primary leg 240 and the lateral leg 238, only through the primary leg 240, or only through the lateral leg 238. The deflector may be operated remotely using a radio frequency identity tag (RFID), an electric control line, or by hydraulic activation. Other means of positioning the deflector remotely may also be used, without departing from the scope of the present disclosure.

Figure 3A:
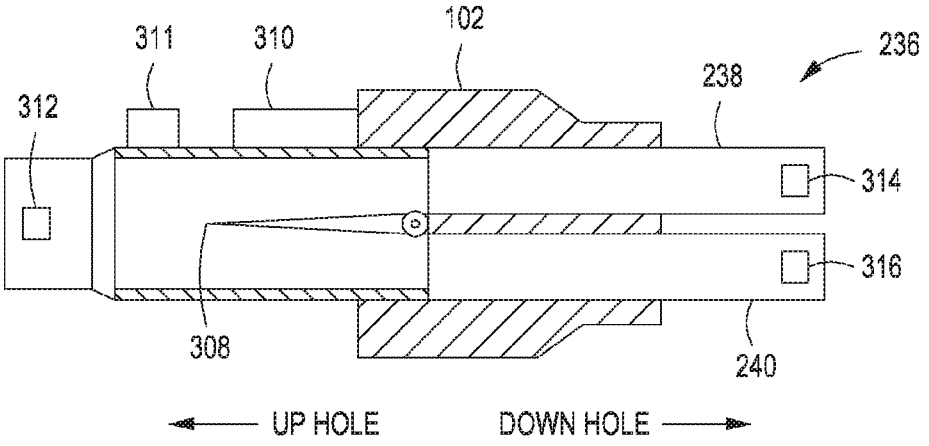
FIGS. 3A, 3B, and 3C depicts a cross-sectional side view of an exemplary multilateral junction, according to one or more embodiments of the present disclosure.
Figure 3B:
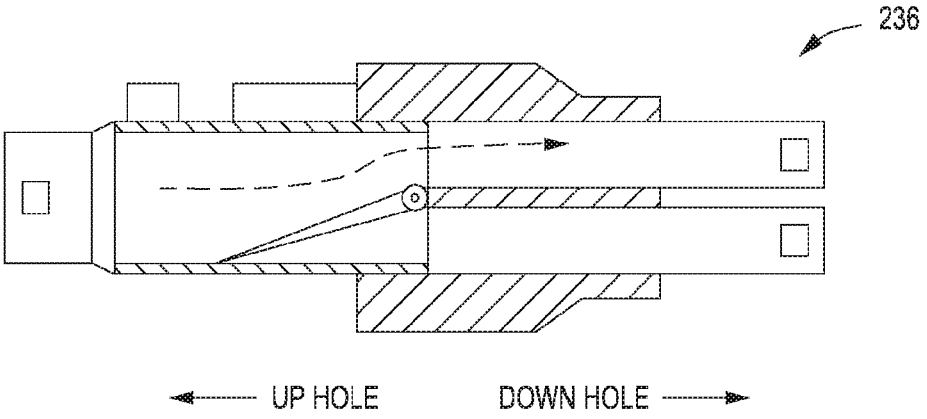
Figure 3C:
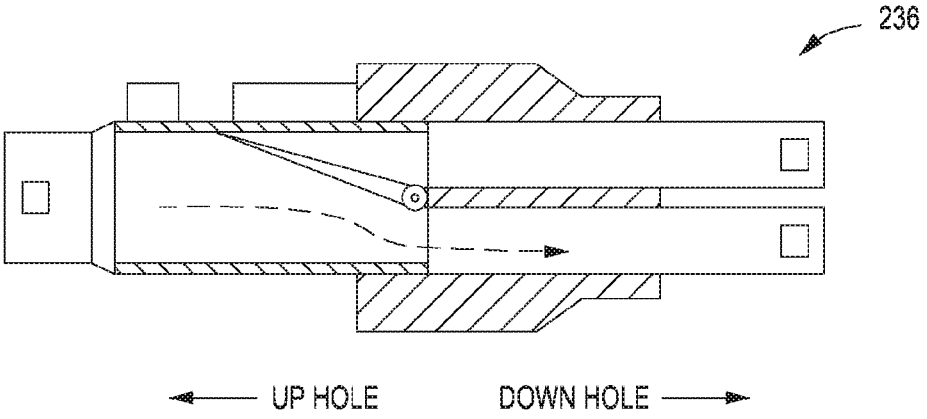

Referring now to FIGS. 3A-C, with continued reference to FIG. 2, illustrated is a cross-section of an exemplary multilateral junction 236 comprising internal deflector 308. Referring now to FIG. 3A, the multilateral junction 236 comprises a deflector 308, and a primary leg 240 and a lateral leg 238, each having a fluid borehole therethrough. The multilateral junction 236 further may comprise, as shown, a controller 310, a radio 311, and an antenna 312. In some embodiments, the multilateral junction 236 may further comprise a second antenna 314 coupled to the lateral leg 238 and a third antenna 316 coupled to the primary leg 240.

In FIG. 3A, the deflector 308 is shown in the neutral position, allowing fluid flow through the lateral leg 238 and the primary leg 240. In FIG. 3B, the deflector 308 is shown in the lateral leg 238 position; and in FIG. 3C, the deflector 308 is shown in the primary leg 240 position. The dotted arrow in FIG. 3B indicates that fluid flow would be deflected into the lateral leg 238 borehole when the deflector 308 is in the lateral leg 238 position. The dotted arrow in FIG. 3C indicates that fluid flow would be deflected into the primary leg 240 borehole when the deflector 308 is in the primary leg 240 position. During the process of drilling the window 114 (FIG. 2) and the lateral wellbore (see FIG. 4), the deflector 308 is in the lateral leg 238 position so that flow is directed through the lateral leg 238, which may be used to power the motor 232 (FIG. 2) and the drill bit 226 (FIG. 2). Upon landing the multilateral junction 236 and actuating at least one screen, the deflector 308 is positioned in the neutral position such that flow from the lateral wellbore (see FIG. 4) and the parent wellbore 102 (FIG. 2) can be commingled. As used herein, the term "landing" with reference to the multilateral junction means forming a fluidic coupling between the primary leg 240 of the multilateral junction 236 and the whipstock 204.

Referring again to FIG. 2, it is to be understood that while FIG. 2 describes a specific arrangement of the plurality of components forming the tool 200, other arrangements may be possible, without departing from the scope of the present disclosure. For example, in some arrangements, the MWD tool 230 may be between the multilateral junction 236 and the screen(s) 234, or the motor 232 may be between the multilateral junction 236 and the screen(s) 234, and the like.

Figure 4:
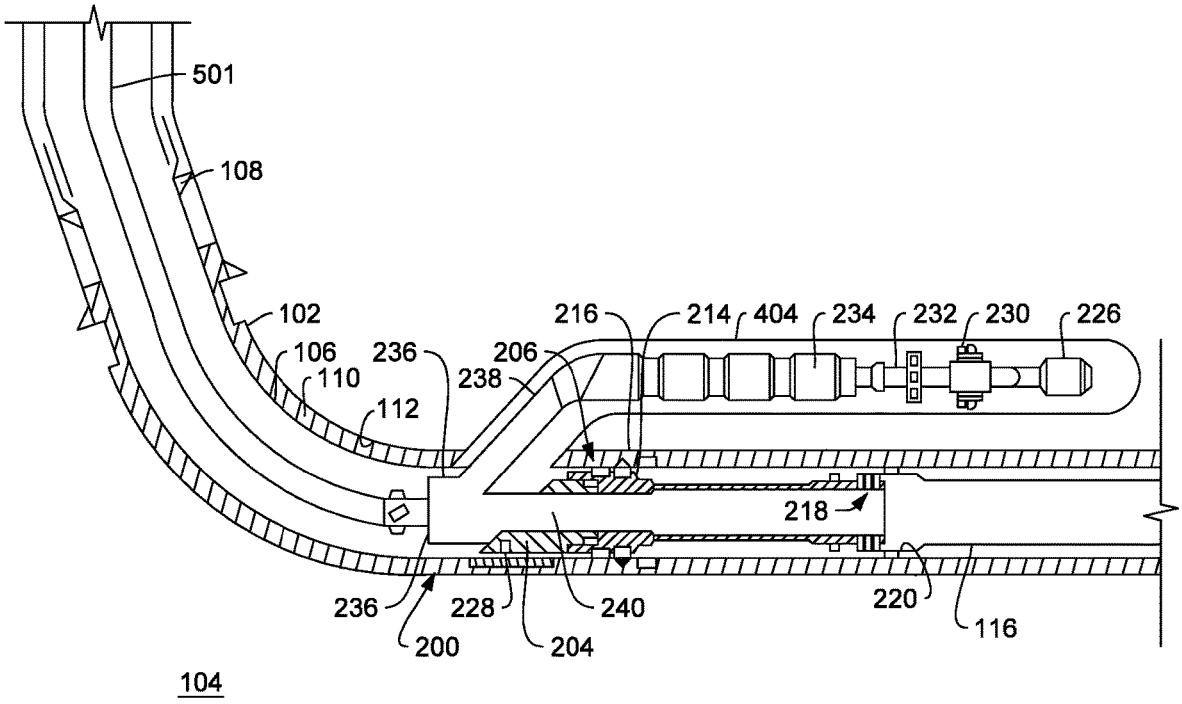
FIG. 4 depicts a cross-sectional side view of an exemplary one-trip multilateral tool after a lateral wellbore has been drilled, according to one or more embodiments of the present disclosure.

Referring now to FIG. 4, with continued reference to FIG. 2, illustrated is a lateral completion of lateral wellbore 404 using tool 200. The whipstock 204 is secured in the parent wellbore 102 by latch anchor 206, which includes a latch profile 214 releasably coupled to latch coupling 216 installed in the casing 106. Further, as shown, the whipstock 204 additionally includes a lower stinger assembly 218 that extends from the latch anchor 206 and is configured to be received within a seal bore 220 of the lower liner 116. The drill bit 226 has been sheared from the shear bolt 228 and deflected to mill through window 114 (FIG. 1) and to form lateral wellbore 404. As the drill bit 226 drills the lateral wellbore 404, as described above, the MWD tool 230, the motor 232, the screen(s) 234, and the lateral leg 238 of the multilateral junction 236 are conveyed into the lateral wellbore 404.

After the drill bit 226 reaches a desired depth or length for forming the lateral wellbore 404, the primary leg 240 of the multilateral junction 236 fluidically couples to the whipstock 204, such that fluid flow from the parent wellbore 102 can flow through the primary leg 240 (see FIG. 4 and deflector 308). The primary leg may be secured to the whipstock 204 by one or more seals 242 in the whipstock 204 (FIG. 2). In other embodiments, the primary leg may additionally be secured in the parent wellbore 102 by deploying slips against the casing 106, by expanding a portion of the multilateral junction 236 to engage the casing 106 or a liner hanger, or by another mechanism, without departing from the scope of the present disclosure.

Accordingly, upon landing the multilateral junction 236, the screen(s) 234 are actuated and the deflector 308 (FIG. 3) is set in the neutral position. Thus, a flow area is formed through the actuated screen(s) 204 and the lateral leg 238 of the multilateral junction 236 into the lateral wellbore 404, as well as through the whipstock 204 and the primary leg 240 of the multilateral junction 236 into the parent wellbore 102, where the produced fluids are commingled and are produced to a surface location. This open flow area is termed the "open inner bore configuration" of the tool 200. It will be appreciated that although the open inner bore configuration is capable of receiving produced fluids from both the lateral wellbore 404 and the parent wellbore 102, only one of the lateral wellbore 404 or the parent wellbore 102 may be producing fluids at any given time, or both, without departing from the scope of the present disclosure.

Figure 5:
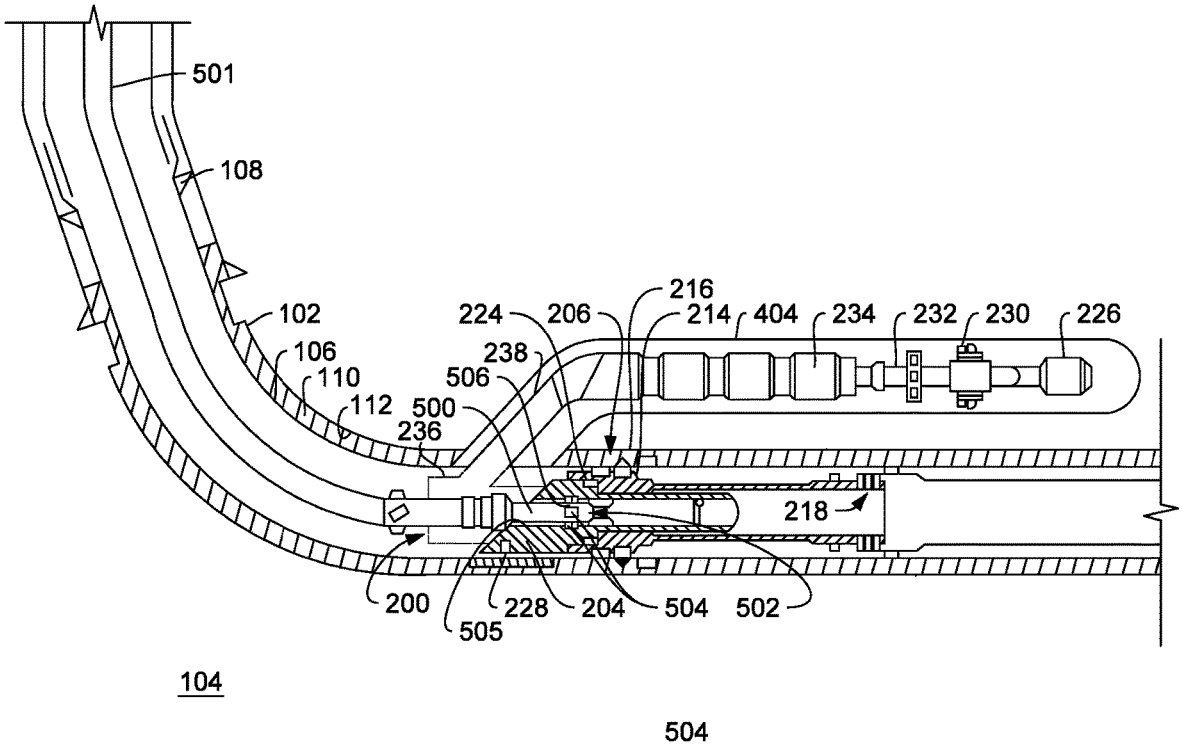
FIG. 5 depicts a retrieval tool engaging a one-trip multilateral tool, according to one or more embodiments of the present disclosure.

Referring now to FIG. 5, with continued reference to FIGS. 2 and 4, as previously discussed, the tool 200 may be retrieved using a retrieval tool after production of hydrocarbons is complete or at another desired time. A retrieval tool 500 may be advanced through the primary leg 240 of the multilateral tool 236 (shown in phantom) and into the borehole 505 of the whipstock 204. The retrieval tool 500 may be conveyed into the parent wellbore 102 on a tool string 501. The retrieval tool 500 may be operatively coupled to the whipstock 204 within the whipstock bore 502 via a coupling engagement 502. The coupling engagement 502 may comprise a variety of coupling mechanisms or methods capable of securing the retrieval tool 500 to the whipstock 204. In one embodiment, for instance, the coupling engagement 502 may include one or more dogs 504 disposed about the retrieval tool 500 and configured to locate and engage a whipstock profile 506 defined on the inner surface of the whipstock bore 505. In at least one embodiment, the dogs 504 may be actuatable (e.g., mechanically, electromechanically, hydraulically, pneumatically, etc.), but may alternatively be spring-loaded. In other embodiments, the coupling engagement 502 may comprise a collet or the like.

Once the retrieval tool 500 is suitably secured to the whipstock 204, the tool string 501 may then be pulled in the uphole direction (i.e., toward the surface of the well) to separate the whipstock 204 from the latch anchor 206, which remains firmly secured within the parent wellbore 102. More particularly, pulling on the tool string 501 in the uphole direction will place an axial load on the releasable connection 224 that eventually overcomes the engagement force provided or otherwise generated by the releasable connection 224. Upon overcoming the engagement force, the whipstock 204 may then be separated from the latch anchor 206 and the tool 200 retrieved to the surface as coupled to the tool string 501. Removing the whipstock 204 from the latch anchor 206 exposes a portion of the releasable connection 224, which may now be able to receive and otherwise couple to other downhole tools or devices.

Embodiments disclosed herein include:

Embodiment A

A method comprising: releasably connecting a latch anchor component within a parent wellbore lined at least partially with casing; deflecting a drill bit component and a whipstock component to mill a window in the casing; drilling a lateral wellbore through the window with the drill bit, the lateral wellbore extending from the parent wellbore; landing a multilateral junction component with lateral leg in the lateral wellbore and a primary leg in the parent wellbore; and actuating the at least one screen component, wherein each of the latch anchor component, the drill bit component, the whipstock component, the multilateral junction component, and the at least one screen component comprise a multilateral tool and are operatively coupled together such that movement of a component correspondingly moves the adjacent component.

Embodiment A may have one or more of the following additional elements in any combination:

Element A1: Wherein the drill bit is operatively coupled to the whipstock by a shear bolt.

Element A2: wherein the multilateral junction comprises an inner deflector selectable to a neutral position, a lateral leg position, and a primary leg position, and further comprising: selecting the lateral leg position until the at least one screen is actuated.

Element A3: wherein the multilateral junction comprises an inner deflector selectable to a neutral position, a lateral leg position, and a primary leg position, and further comprising: selecting the neutral position after the at least one screen is actuated.

Element A4: Wherein the multilateral tool has an open inner bore configuration, and further comprising producing a wellbore fluid through the open inner bore configuration from the parent wellbore and/or the lateral wellbore to a surface location.

Element A5: Wherein the multilateral tool further comprises a measurement while drilling (MWD) tool component, and further comprising detecting a wellbore condition with the MWD tool component.

Element A6: Further comprising conveying the multilateral tool into the parent wellbore using a drill string operatively coupled to the multilateral tool.

Element A7: further comprising: releasing the releasable connection; and retrieving the multilateral tool to a surface location.

By way of non-limiting example, exemplary combinations applicable to A include: A1-A7; A1, A3, and A6; A6 and A7; A2 and A6; A4, A5, and A7; A1 and A5; and the like.

Embodiment B

A system comprising: a parent wellbore lined at least partially with casing that includes a latch coupling; a lateral wellbore extending from the parent wellbore; a multilateral tool conveyable into the parent wellbore and the lateral wellbore, the multilateral tool having a plurality of components operatively coupled together such that movement of a component correspondingly moves the adjacent component and comprising: a whipstock having a latch anchor; a drill bit; a measurement while drilling (MWD) tool; a motor; at least one well screen; and a multilateral junction having a primary leg and a lateral leg.

Embodiment B may have one or more of the following additional elements in any combination:

Element B1: Wherein the latch anchor is releasably connected within the parent wellbore by mating a latch profile of the latch anchor with the latch coupling.

Element B2: Wherein the lateral leg of the multilateral junction is conveyable into the lateral wellbore and the primary leg of the multilateral junction is conveyable into the parent wellbore.

Element B3: Further comprising a drill string operatively coupled to the multilateral tool.

Element B4: Wherein the multilateral junction comprises an inner deflector selectable to a neutral position, a lateral leg position, and a primary leg position, and the inner deflector being in one of the neutral position, the lateral leg position, or the primary leg position.

Element B5: Further comprising a retrieval tool operatively coupled to the whipstock.

Element B6: Wherein the multilateral tool has an open inner bore configuration through which wellbore fluids can flow, and further comprising produced fluids in the open inner bore configuration of the multilateral tool.

By way of non-limiting example, exemplary combinations applicable to B include: B1-B6; B2 and B5, B1, B3, and B4; B5 and B6; B2 and B4; B3, B4, and B6; B1 and B2; and the like.

Embodiment C

A multilateral tool having a plurality of components operatively coupled together such that movement of a component correspondingly moves the adjacent component and comprising: a whipstock having a latch anchor; a drill bit; a measurement while drilling (MWD) tool; a motor; at least one well screen; and a multilateral junction having a primary leg and a lateral leg.

Embodiment C may have one or more of the following additional elements in any combination:

Element C1: Wherein the multilateral wellbore tool comprises a plurality of screens between the first end of the motor and the lateral leg of the multilateral junction.

Element C2: Wherein the multilateral junction comprises an inner deflector selectable to a neutral position, a lateral leg position, and a primary leg position.

Element C3: Wherein the multilateral tool has an open inner bore configuration through which wellbore fluids can flow.

Element C4: Wherein the whipstock comprises a whipstock bore having a coupling engagement for securing a retrieval tool.

By way of non-limiting example, exemplary combinations applicable to C include: C1-C4, C1 and C2; C1 and C3; C1 and C4; C2 and C3; C2 and C4; C3 and C4; C1, C2, and C3; C1, C2, and C4; C2, C3, and C4; and the like.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

The use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well. Further, it is understood that the illustrations of the embodiments described herein are not intended to represent the relative sizes of any of the components but to illustrate the function of the several components. Accordingly, the lengths, the diameters, and the thicknesses of the components may be different than illustrated, without departing from the scope of the present disclosure.

What is claimed is:

1. A method comprising:

releasably connecting a latch anchor component within a parent wellbore lined at least partially with casing, wherein the latch anchor component is attached to a whipstock component with a releasable connection;

deflecting a drill bit component with the whipstock component to mill a window in the casing;

drilling a lateral wellbore through the window with the drill bit, the lateral wellbore extending from the parent wellbore;

landing a multilateral junction component with a lateral leg in the lateral wellbore and a primary leg in the parent wellbore;

actuating at least one screen component, wherein each of the latch anchor component, the drill bit component, the whipstock component, the multilateral junction component, and the at least one screen component form a multilateral tool;

releasing the whipstock component from the latch anchor with a retrieval tool, to expose a portion of the releasable connection;

retrieving the whipstock component, the drill bit component, the at least one screen component, and the multilateral junction component from the parent and lateral wellbores during a single trip; and leaving the latch anchor with the releasable connection in the parent wellbore, wherein the releasable connection is configured to receive and couple to another downhole tool.

2. The method of claim 1, wherein the drill bit is operatively coupled to the whipstock by a shear bolt.

3. The method of claim 1, wherein the multilateral junction comprises an inner deflector selectable to a neutral position, a lateral leg position, and a primary leg position, and further comprising:

selecting the lateral leg position until the at least one screen is actuated.

4. The method of claim 1, wherein the multilateral junction comprises an inner deflector selectable to a neutral position, a lateral leg position, and a primary leg position, and further comprising:

selecting the neutral position after the at least one screen is actuated.

5. The method of claim 1, wherein the multilateral tool has an open inner bore configuration, and further comprising producing a wellbore fluid through the open inner bore configuration from the parent wellbore and/or the lateral wellbore to a surface location.

6. The method of claim 1, wherein the multilateral tool further comprises a measurement while drilling (MWD) tool component, and further comprising detecting a wellbore condition with the MWD tool component.

7. The method of claim 1, further comprising conveying the multilateral tool into the parent wellbore using a drill string operatively coupled to the multilateral tool.

8. The method of claim 1, further comprising:

releasing the latch anchor component; and retrieving the multilateral tool to a surface location.

9. A system comprising:

a parent wellbore lined at least partially with casing that includes a latch coupling;

a lateral wellbore extending from the parent wellbore;

a multilateral tool conveyable into the parent wellbore and the lateral wellbore, the multilateral tool having a plurality of components comprising:

a whipstock coupled to a latch anchor with a releasable connection, the latch anchor configured to couple to the latch coupling in the parent wellbore;

a drill bit;

a measurement while drilling (MWD) tool;

a motor;

at least one well screen; and a multilateral junction having a primary leg and a lateral leg; and wherein the drill bit, the whipstock, the MWD tool, the motor, the at least one well screen, and the multilateral junction are retrievable with a retrieval tool during a single trip, wherein the latch anchor and the releasable connection are configured to remain in the parent wellbore upon retrieval of the drill bit, the whipstock, the MWD tool, the motor, the at least one well screen, and the multilateral junction.

10. The system of claim 9, wherein the latch anchor is releasably connectable within the parent wellbore by mating a latch profile of the latch anchor with the latch coupling.

11. The system of claim 9, wherein the lateral leg of the multilateral junction is conveyable into the lateral wellbore and the primary leg of the multilateral junction is conveyable into the parent wellbore.

12. The system of claim 9, further comprising a drill string operatively coupled to the multilateral tool.

13. The system of claim 9, wherein the multilateral junction comprises an inner deflector selectable to a neutral position, a lateral leg position, and a primary leg position, and the inner deflector being in one of the neutral position, the lateral leg position, or the primary leg position.

14. The system of claim 9, further comprising the retrieval tool operatively connectable to the whipstock.

15. The system of claim 9, wherein the multilateral tool has an open inner bore configuration through which wellbore fluids can flow, and further comprising produced fluids in the open inner bore configuration of the multilateral tool.

16. A multilateral tool having a plurality of components comprising:

a whipstock coupled to a latch anchor with a releasable connection, the latch anchor configured to couple to casing that is disposed in a parent wellbore;

a drill bit;

a measurement while drilling (MWD) tool;

a motor;

at least one well screen; and a multilateral junction having a primary leg and a lateral leg; and wherein the drill bit, the whipstock, the MWD tool, the motor, the at least one well screen component, and the multilateral junction component are retrievable with a retrieval tool during a single trip, wherein the latch anchor and the releasable connection are configured to remain in the parent wellbore upon retrieval of the drill bit, the whipstock, the MWD tool, the motor, the at least one well screen, and the multilateral junction.

17. The multilateral tool of claim 16, wherein the multilateral wellbore tool comprises a plurality of screens between the motor and the lateral leg of the multilateral junction.

18. The multilateral tool of claim 16, wherein the multilateral junction comprises an inner deflector selectable between a neutral position, a lateral leg position, and or primary leg position.

19. The multilateral tool of claim 16, wherein the multilateral tool has an open inner bore configuration through which wellbore fluids can flow.

20. The multilateral tool of claim 16, wherein the whipstock comprises a whipstock bore having a coupling engagement for securing the retrieval tool.

* * * * *